US006877999B2

(12) United States Patent
Hashimoto

(10) Patent No.: US 6,877,999 B2
(45) Date of Patent: Apr. 12, 2005

(54) CONNECTOR SHUTTER

(75) Inventor: Shinichi Hashimoto, Kawasaki (JP)

(73) Assignee: Tyco Electronics AMP K.K., Kawasaki (JP)

( * ) Notice: Subject to any disclaimer, the term of this patent is extended or adjusted under 35 U.S.C. 154(b) by 0 days.

(21) Appl. No.: 10/358,755

(22) Filed: Feb. 5, 2003

(65) Prior Publication Data

US 2003/0148645 A1 Aug. 7, 2003

(30) Foreign Application Priority Data

Feb. 5, 2002 (JP) ..... 2002-028600

(51) Int. Cl.[7] ..... H01R 13/44
(52) U.S. Cl. ..... 439/138; 439/374
(58) Field of Search ..... 439/137, 138, 439/135, 136, 139, 108, 374

(56) References Cited

U.S. PATENT DOCUMENTS 1,579,865 A * 4/1926 Hubbell ..... 439/138
4,176,897 A * 12/1979 Cameron ..... 439/138
5,559,672 A * 9/1996 Buras et al. ..... 361/684
5,716,224 A * 2/1998 Masuda et al. ..... 439/138
5,796,579 A 8/1998 Nakajima et al.
6,332,781 B1 * 12/2001 Ito ..... 439/34
2001/0031570 A1 10/2001 Horikoshi et al.

FOREIGN PATENT DOCUMENTS

JP 07 045328 2/1995

* cited by examiner

*Primary Examiner*—Hien Vu

(57) ABSTRACT

The present invention provides a connector shutter which makes it possible to reduce the space between the connector and the shutters. The connector shutters are installed in the housing of an electronic device so that the mating recesses of the connector are opened and closed by these connector shutters. These connector shutters are caused to pivot as a result of the tip ends of the connector shutters being contacted by the guide parts of the mating connector, so that the mating recesses of the connector are opened. The pivoting shafts of the connector shutters are disposed facing the end surfaces and of the connector at both ends of the connector with respect to the lengthwise direction, and the contact parts of the tip ends of the shutters that are contacted by the guide parts include protruding parts that protrude further than the other portions of these tip ends.

15 Claims, 9 Drawing Sheets

CONNECTOR SHUTTER

BACKGROUND OF THE INVENTION

1. Field of the Invention

The present invention relates to a connector shutter which opens and closes the mating recess of a connector.

2. Related Applications

Priority is claimed to Japanese Patent Application No. 2002-028600 filed on Feb. 5, 2002, which is hereby incorporated by reference.

3. Description of the Related Art

Generally, in order to connect external devices to electronic devices such as notebook-type personal computers, connectors that mate with each other are respectively disposed on these electronic devices and external devices. Furthermore, in the case of electronic devices such as notebook-type computers, there is a danger that foreign matter will enter the mating recess of the connector (used for mating of the mating connector) and adhere to the contacts of the connector in a state in which no external device is connected; accordingly, an anti-dust shutter which prevents invasion of the mating recess by such foreign matter is provided.

FIG. 11 shows a conventional example in which an anti-dust shutter is installed in the opening part of the housing of an electronic device (see Japanese Patent Application Kokai No. H7-45328).

In the example shown in FIG. 11, an internal connector 100 which is installed inside the housing 110 of the electronic device mates with an external connector 200 which is installed on the housing 210 of an external device. The external connector 200 has a substantially rectangular housing 201 that extends in the direction of length (i.e., the direction perpendicular to the plane of the page), and a mating part 202 is formed so that this mating part 202 protrudes from the housing 201.

The internal connector 100 located in the interior of the housing 110 of the electronic device has a substantially rectangular housing 101 that extends in the direction of length, and a mating part 102 that mates with the mating part 202 of the external connector 200 is disposed in this housing 101. Furthermore, an opening part 111 which extends in the direction of length, and which allows the insertion of the external connector 200, is formed in the housing 110 of the electronic device, and this opening part 111 can be opened and closed by anti-dust shutters 120 attached to the housing 110.

The anti-dust shutters 120 are disposed as a pair on both sides of the opening part 111. Each anti-dust shutter 120 comprises a base end part 121 which is fastened to the housing 110, a cover part 123 which is used to open and close the opening part 111, and a connecting part 122 which connects the base end part 121 and cover part 123. These parts are formed as an integral unit from an elastic material. The connecting part 122 is formed with a small thickness so that this connecting part 122 can easily be bent by an external force acting on the cover part 123; furthermore, the connecting part 122 has a cross-sectional shape that positions the cover part 123 in a state that closes the opening part 111 by means of elastic force in cases where no external force acts on the cover part 123. Moreover, the cover part 123 has a shape that extends in the direction of length in order to allow opening and closing of the opening part 111 extending in the direction of length.

Next, the action of the anti-dust shutters 120 may be described as follows: first, in the state shown in FIG. 11(A), the cover parts 123 of the anti-dust shutters 120 close the opening part 111 by virtue of the elastic force of the connecting parts 122. As a result, the entry of foreign matter into the interior from the opening part 111 is prevented. Then, when the mating connector 200 is inserted into the interior of the housing 110 of the electronic device via the opening part 111, the cover parts 123 of the anti-dust shutters 120 open as shown in FIG. 11(B), so that the mating part 202 of the mating connector 200 is mated and connected to the mating part 102 of the connector 100. In the opening action of the anti-dust shutters 120, the tip end of the mating part 202 of the mating connector 200 first contacts the tip ends of the cover parts 123 of the respective anti-dust shutters 120. Then, as the insertion of the mating connector 200 proceeds, the tip ends of the cover parts 123 are pushed and opened along the outer circumference of the mating part 202 and the outer circumference of the housing 201. Next, when the mating of the mating part 202 and mating part 102 is completed, the cover parts 123 maintain a state of contact with the outer circumference of the housing 201 of the mating connector 200 as shown in FIG. 11(B).

Furthermore, when the mating connector 200 is pulled out from the state of completed mating by an operation that is the reverse of that described above, the mated state of the mating parts 102 and 202 is released, and the cover parts 123 of the anti-dust shutters 120 close the opening part 111.

However, the following problems have been encountered in the conventional example shown in FIG. 11.

Specifically, the anti-dust shutters 120 must be disposed a considerable distance above the internal connector 100 in order to prevent the cover parts 123 from interfering with the internal connector 100 when the cover parts 123 of the anti-dust shutters 120 pivot. Thus, a large space is required between the internal connector 100 and the anti-dust shutters 120.

SUMMARY OF THE INVENTION

Accordingly, the present invention was devised in light of the above-mentioned problems, and it is an object of the present invention to provide a connector shutter which does not require a large space between the shutter and the connector, so that the total height of the connector and shutter can be reduced.

In order to solve the above-mentioned problems, the connector shutter in accordance with the present invention is a connector shutter which is installed so as to open and close the mating recess of a connector, and which is caused to pivot by the contact of the guide part of a mating connector with the tip ends of shutters so that the mating recess of the connector is opened, wherein pivoting shafts of said shutters are disposed facing the end surfaces at both ends of the connector with respect to the lengthwise direction, and the portions of the tip ends that are contacted by the guide part include protruding parts that protrude further than the other portions of the tip ends.

In this connector shutter, when the mating connector is inserted into the mating recess, the guide part of the mating connector contacts the portions of the tip ends of the shutters that correspond to the contact parts. Then, as the insertion operation of the mating connector proceeds, the guide part is inserted and caused to advance along the contact parts so that the shutters are pushed open. In this opening operation of the shutters, since the contact parts include protruding parts that protrude further than the other portions of the tip ends of the shutters, the guide part of the mating connector is inserted and caused to advance along the protruding parts, so that the shutters are pushed open by this insertion and advance. Furthermore, since the pivoting shafts of the shutters are disposed facing the end surfaces of the connector at both ends of the connector with respect to the lengthwise direction, there is no need for a large space between the shutters and the connector. Moreover, this expression indicating that the pivoting shafts of the shutters are disposed facing the end surfaces of the connector at both ends of the connector with respect to the lengthwise direction includes cases in which the pivoting shafts of the shutters are disposed on the shutters themselves facing the end surfaces of the connector at both ends of the connector with respect to the lengthwise direction, cases in which the pivoting shafts of the shutters are disposed on the housing facing the end surfaces of the connector at both ends of the connector with respect to the lengthwise direction, and cases in which the pivoting shafts of the shutters are disposed on the end surfaces themselves of the connector at both ends of the connector with respect to the lengthwise direction.

Furthermore, in a preferred embodiment of the present application, the protruding parts protrude into the interior of the mating recess when the shutters close the mating recess. In this embodiment, since the protruding parts protrude into the interior of the mating recess when the mating recess is closed by the shutters, the degree of opening of the shutters can be increased in the opening operation of the shutters, so that catching on the shutters by the mating connector is prevented even in cases where the mating connector is inserted with the center of the mating connector deviating from the center of the shutter.

DESCRIPTION OF THE PREFERRED EMBODIMENTS

Figure 1:
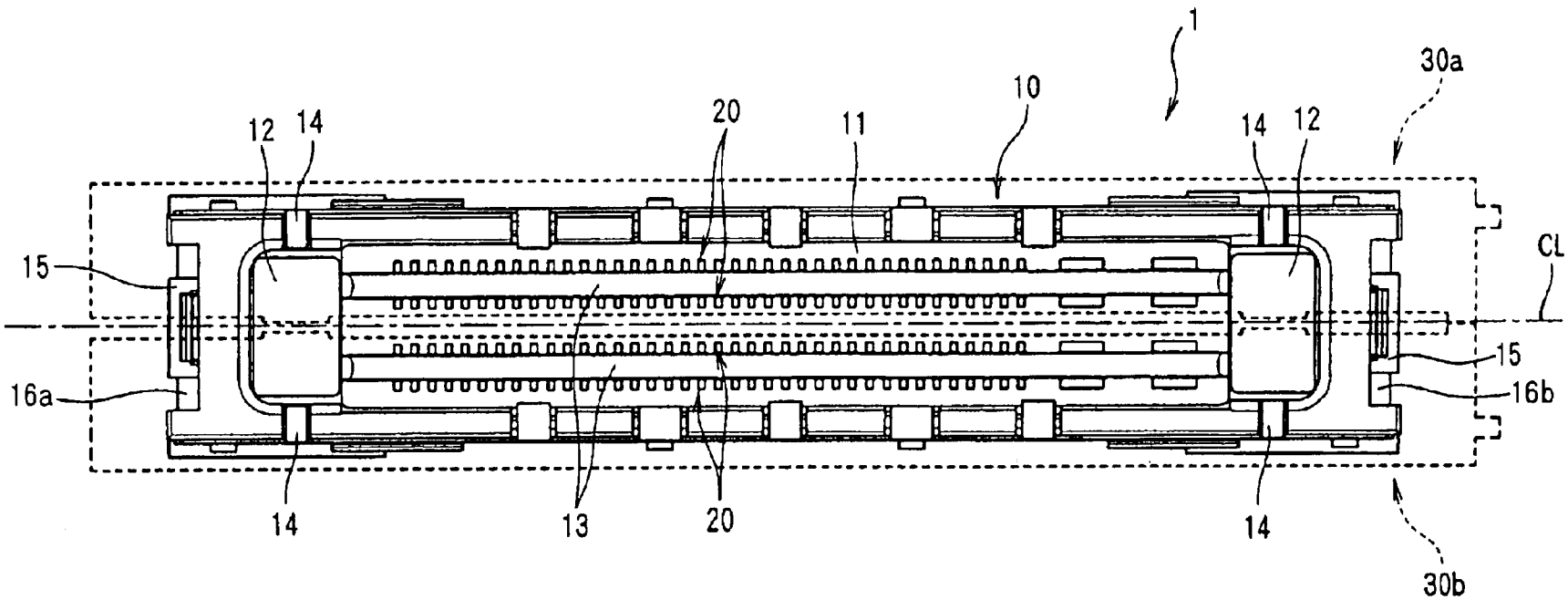
FIG. 1 is a plan view of a connector that is opened and closed by the shutter of the present invention (in FIG. 1, the pair of anti-dust shutters are indicated by broken lines)
Figure 2:
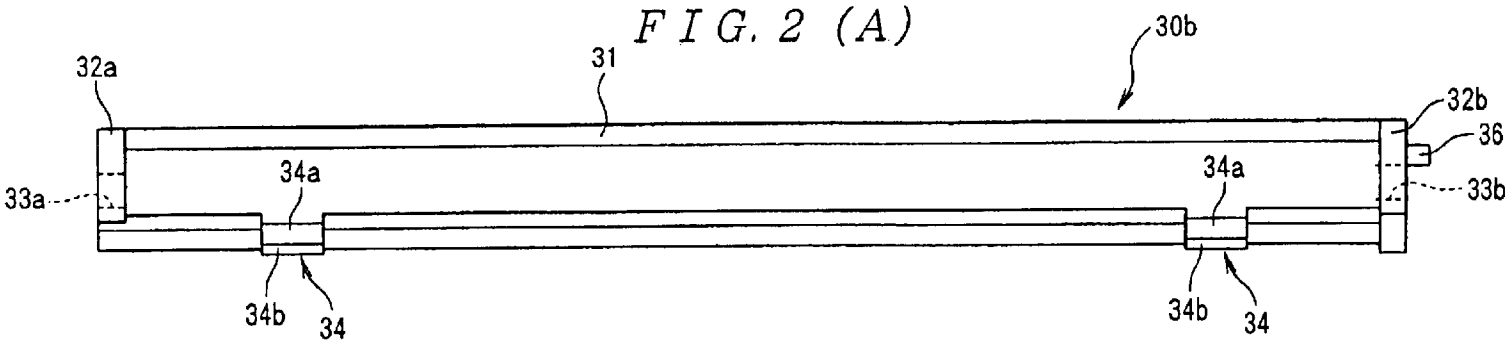
FIG. 2 shows the anti-dust shutter located on one side that is used in the connector shown in FIG. 1, with FIG. 2(A) showing a bottom view, FIG. 2(B) showing a back view, FIG. 2(C) showing a sectional view along line 2C—2C in FIG. 2(B), and FIG. 2(D) showing a sectional view along line 2D—2D in FIG. 2(B)
Figure 2:
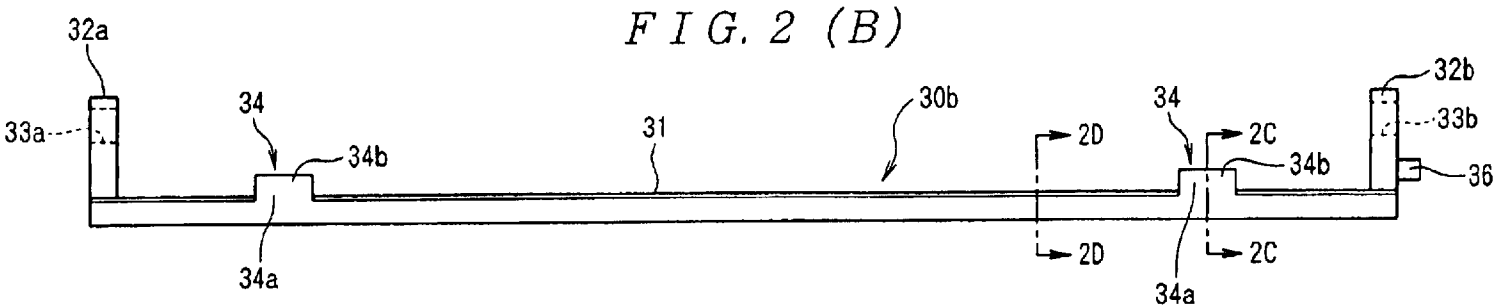
Figure 2:
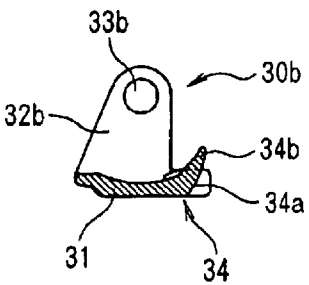
Figure 2:
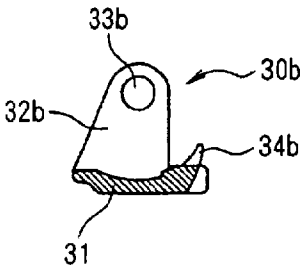
Figure 3:
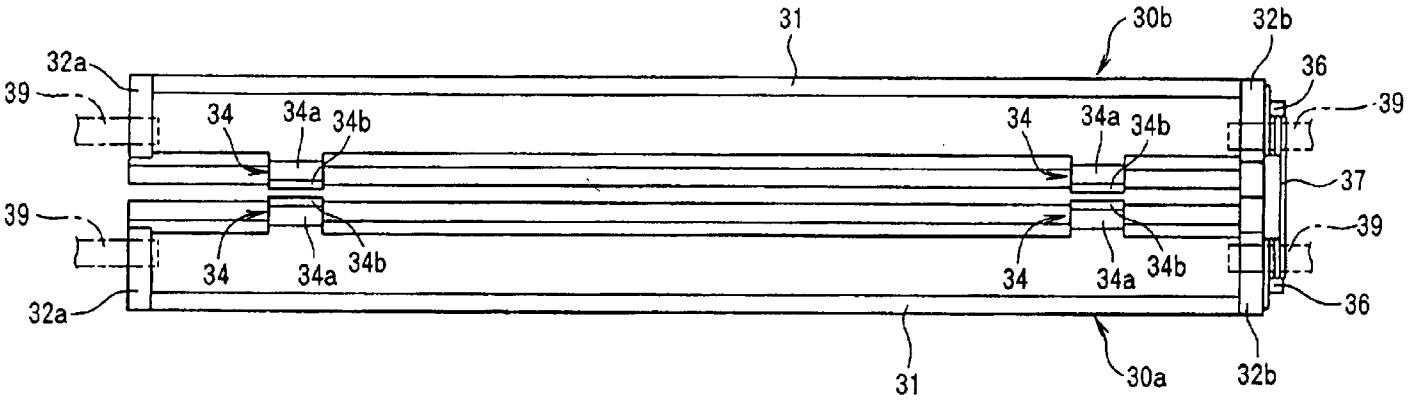
FIG. 3 shows a state in which the pair of anti-dust shutters are attached to the housing, with FIG. 3(A) showing a bottom view, FIG. 3(B) showing a back view, and FIG. 3(C) showing a side view.
Figure 3:
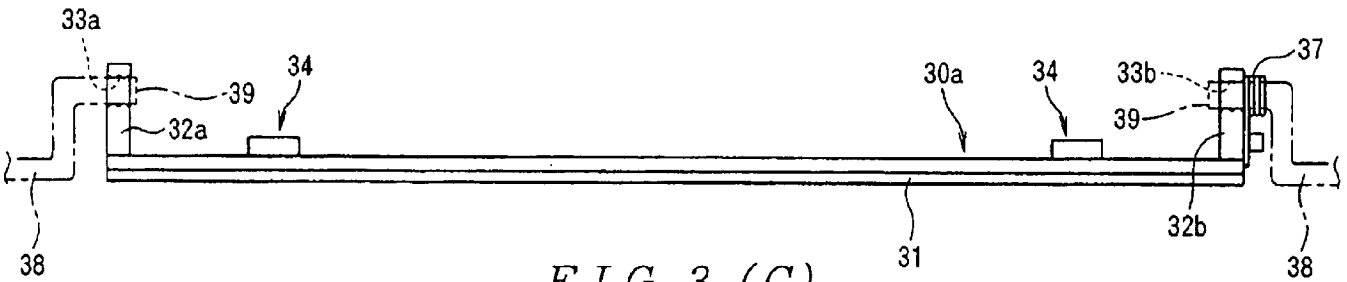
Figure 3:
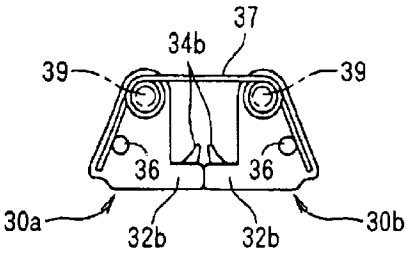
Figure 4:
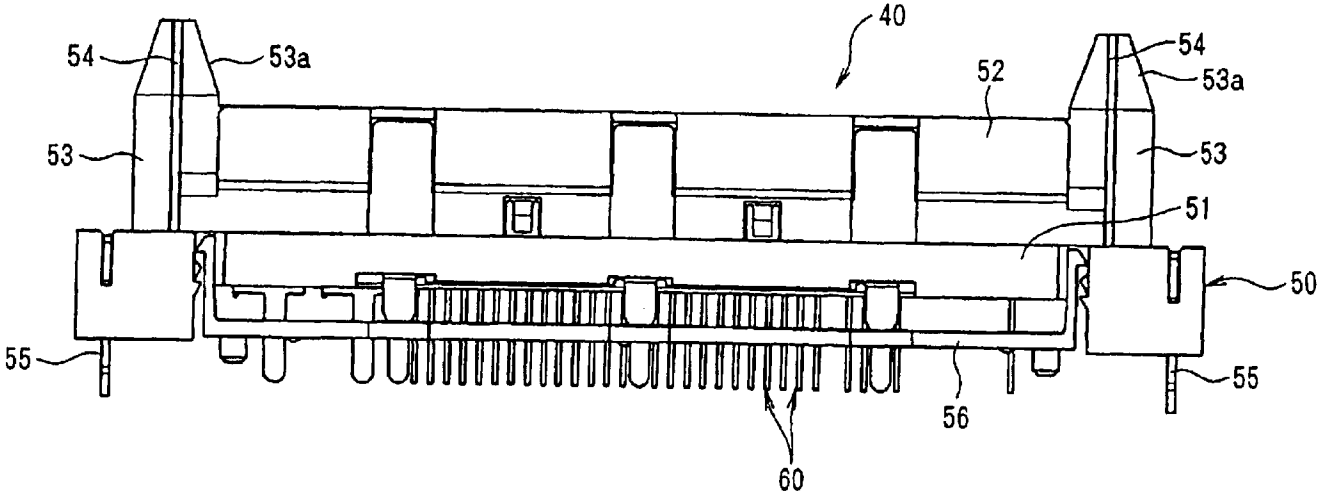
FIG. 4 shows the mating connector that is mated with the connector shown in FIG. 1, with FIG. 4(A) showing a front view, and FIG. 4(B) showing a right-side view.
Figure 4:
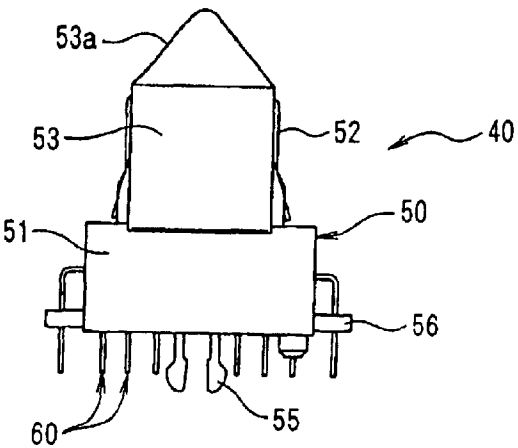

Next, embodiments of the present invention will be described with reference to the attached figures. FIG. 1 is a plan view of a connector that is opened and closed by the shutter of the present invention. In FIG. 1, the pair of anti-dust shutters are indicated by a broken line. FIG. 2 shows the anti-dust shutter located on one side that is used in the connector shown in FIG. 1, with FIG. 2(A) showing a bottom view, FIG. 2(B) showing a back view, FIG. 2(C) showing a sectional view along line 2C—2C in FIG. 2(B), and FIG. 2(D) showing a sectional view along line 2D—2D in FIG. 2(B). FIG. 3 shows a state in which the pair of anti-dust shutters are attached to the housing, with FIG. 3(A) showing a bottom view, FIG. 3(B) showing a back view, and FIG. 3(C) showing a side view. FIG. 4 shows the mating connector that is mated with the connector shown in FIG. 1, with FIG. 4(A) showing a front view, and FIG. 4(B) showing a right-side view. FIGS. 5 through 10 are sectional views which illustrate the mating action of the mating connector with the anti-dust shutters and connector.

The connector shown in FIG. 1 is disposed in an electronic device (not shown in the figures) such as a notebook-type computer. The mating connector 40 shown in FIG. 4 is mated with this connector in FIG. 1, as is shown in FIGS. 5 through 10, The mating connector 40 shown in FIG. 4 is disposed in an external device such as a port replicator (not shown in the figures), and comprises a mating housing 50 which extends in the lengthwise direction (the left-right direction in FIG. 4(A)) and a plurality of mating contacts 60 which are attached in four rows along the lengthwise direction of this mating housing 50.

The mating housing 50 comprises a base part 51 that extends in the lengthwise direction, and an mating part 52 that extends upward from the upper surface of the base part 51. Furthermore, a pair of metal fastening fittings 55 that are used to fasten the mating housing 50 to the surface of a circuit board (not shown in the figures) are disposed on both end portions of the base part 51 with respect to the lengthwise direction. Furthermore, a pair of guide posts (guide parts) 53 which are used to guide the mating at the time of mating with the connector 1 are disposed on both end portions of the mating part 52 with respect to the lengthwise direction. Each guide post 53 has a protruding part 53*a* that protrudes further upward than the upper end of the mating part 52, and the outer circumferential surface of this protruding part 53*a* is formed as an inclined surface that gradually causes the protruding part 53*a* to become more slender in the upward direction. The reason that the outer circumferential surfaces of the protruding parts 53*a* of the guide posts 53 are thus formed as inclined surfaces that gradually cause the protruding parts 53*a* to become more slender in the upward direction is to facilitate guidance of the mating. Furthermore, metal plates 54 used for the discharge of static electricity which are disposed along the outside of each guide post 53 on the front and rear surfaces (left and right surfaces in FIG. 4(B)). Moreover, a leg part alignment plate 56 which is used to align the leg parts of the mating contacts 60 that protrude downward from the base part 51 is disposed beneath the base part 51, so that this leg part alignment plate 56 can move upward and downward. FIG. 4 shows a state in which the leg part alignment plate 56 is positioned above.

Figure 5:
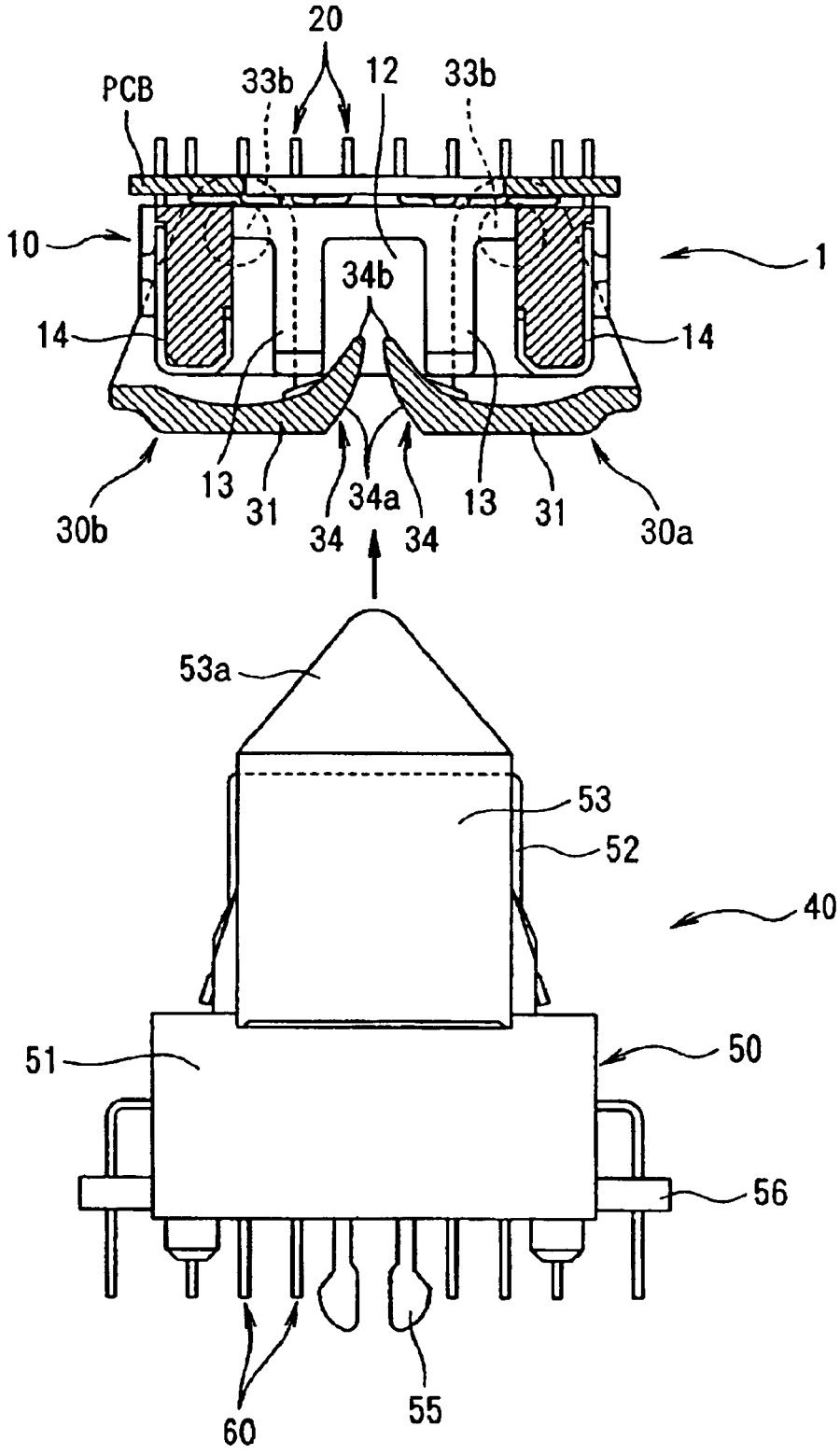
FIG. 5 is a sectional view which illustrates the mating action of the mating connector with the anti-dust shutters and connector (this figure shows a state in which no mating connector is mated with the shutters and connector)

Referring to FIG. 1, the connector 1 comprises a housing 10 and a plurality of contacts 20 that are attached to the housing 10. Furthermore, as is shown in FIG. 3, a pair of anti-dust shutters 30*a* and 30*b* are respectively shaft-supported on supporting shafts 39 disposed on the housing 38 of the electronic device so that these anti-dust shutters 30*a* and 30*b* can pivot. As is shown in FIG. 5, the connector 1 is mounted on a circuit board PCB.

Referring again to FIG. 1, the housing 10 is formed as a substantially rectangular body that extends in the lengthwise direction (left-right direction in FIG. 1), and is formed by molding an insulating resin such as a PBT. A first mating recess 11 which extends in the lengthwise direction, and with which the mating part 52 of the mating connector 40 is mated, is formed in the housing 10, and a pair of second mating recesses 12 into which the guide posts 53 of the mating connector 40 are inserted are formed in both end portions of the first mating recess 11 with respect to the lengthwise direction. Two partition plates (platforms) 13 are disposed in the first mating recess 11 in upright positions with a specified gap left between these partition plates in the forward-rearward direction (the vertical direction in FIG. 1). The respective partition plates 13 extend until these plates reach both end portions of the first mating recess 11 with respect to the lengthwise direction. A plurality of contacts 20 in two rows are attached to each partition plate 13 along the forward-rearward surface of the partition plate 13. These contacts 20 are connected to the circuit board PCB, and are arranged so that these contacts 20 are contacted by the mating contacts 60 when the mating connector 40 is mated. Furthermore, ground plates 14 that are contacted by the static electricity discharge metal plates 54 of the mating connector 40 are disposed on the front and rear walls of the second mating recesses 12 of the housing 10. Moreover, leg part alignment plates 15 which align the leg parts of the contacts 20 of the connector 1 are attached to both end parts of the housing 10 with respect to the direction of length. The mating recess comprises the first mating recess 11 and second mating recesses 12.

Furthermore, the pair of anti-dust shutters 30*a* and 30*b* are formed in shapes that are symmetrical with respect to the center line CL that extends in the lengthwise direction of the connector 1 shown in FIG. 1, and are shaft-supported so that these anti-dust shutters 30*a* and 30*b* can pivot about the supporting shafts 39 of the housing 38 that are disposed facing the end surfaces 16*a* and 16*b* of the housing 10 located at both ends of the housing 10 with respect to the lengthwise direction. These anti-dust shutters 30*a* and 30*b* are thus arranged so that they can open and close the first mating recess 11 and second mating recesses 12. Since the pivoting shafts (shaft holes 33*a* and 33*b*) of the anti-dust shutters 30*a* and 30*b* are disposed facing the end surfaces 16*a* and 16*b* at both ends of the connector 1 with respect to the lengthwise direction, no large space is required between the anti-dust shutters 30*a* and 30*b* and the connector 1, so that the total height of the connector 1 and shutters 30*a* and 30*b* can be reduced. Furthermore, as shown in FIG. 3, a torsion spring 37 biases the anti-dust shutters 30*a* and 30*b* so that these shutters are returned to the initial state. The torsion spring 37 is wound around the circumferences of the two supporting shafts 39 that are disposed facing the end surface 16*b* at the right end of the housing 10 with respect to the lengthwise direction (i.e., the right end in FIG. 1). Since the pair of anti-dust shutters 30*a* and 30*b* are formed in shapes that are symmetrical with respect to the center line CL, only the shape of the anti-dust shutter 30*b* on the front side of the center line CL (i.e., the lower side in FIG. 1) will be described in concrete terms. As is shown in FIG. 2, this anti-dust shutter 30*b* comprises a flat-plate part 31 that extends in the lengthwise direction, and a pair of side plates 32*a* and 32*b* that rise from both end portions of the flat-plate part 31 with respect to the lengthwise. This anti-dust shutter 30*b* is formed by molding an insulating resin such as a PBT. Furthermore, shaft holes 33*a* and 33*b* which are disposed facing the end surfaces 16*a* and 16*b* at both ends of the housing 10 with respect to the lengthwise direction, and which accommodate the supporting shafts 39 of the housing 38, are formed through the respective side plates 32*a* and 32*b*. Moreover, a stopper 36 which anchors the free end of the torsion spring 37 is formed so that this stopper 36 protrudes from the outer surface of the side plate 32*b* that faces the end surface 16*b* on the right end of the housing 10 with respect to the lengthwise direction. Furthermore, a pair of contact parts 34 that are contacted by the guide posts 53 of the mating connector 40 at the time of mating are formed on the tip end (i.e., the right end in FIG. 2(C)) of the flat-plate part 31 in positions corresponding to the guide posts 53 of the mating connector 40 with respect to the direction of length. As is shown in FIG. 5, the pair of anti-dust shutters 30*a* and 30*b* are attached so that these anti-dust shutters 30*a* and 30*b* can pivot on the housing 38 and thus open and close the first mating recess 11 and second mating recesses 12 by the respective flat-plate parts 31. The respective contact parts 34 are positioned in positions corresponding to the second mating recesses 12 when the anti-dust shutter 30*b* is attached. Furthermore, as shown in FIGS. 2 and 5, the respective contact parts 34 are formed on the tip end of the flat-plate part 31, and each comprises a cam part 34*a* that is caused to pivot by the contact of the corresponding guide post 53 of the mating connector 40 so as to open the anti-dust shutter 30*b*, and a protruding part 34*b* which is formed on the tip end of this cam part 34*a*. As is shown most clearly in FIG. 2(D), the protruding parts 34*b* protrude further than the other portions of the tip end of the flat-plate part 31 of the anti-dust shutter 30*b*. Furthermore, as is shown in FIG. 2(C), the protruding parts 34*b* form cam surfaces that cause the anti-dust shutter 30*b* to pivot in the opening direction as continuations of the cam surface of the cam part 34*a*. Moreover, as is shown in FIG. 5, the protruding parts 34*b* are constructed so that these parts protrude into the interiors of the second mating recesses 12 when the first mating recess 11 and second mating recesses 12 are closed by the anti-dust shutters 30*a* and 30*b*.

Next, the mating action of the mating connector 40 with the anti-dust shutters 30*a* and 30*b* and connector 1 will be described with reference to FIGS. 5 through 10.

Figure 6:
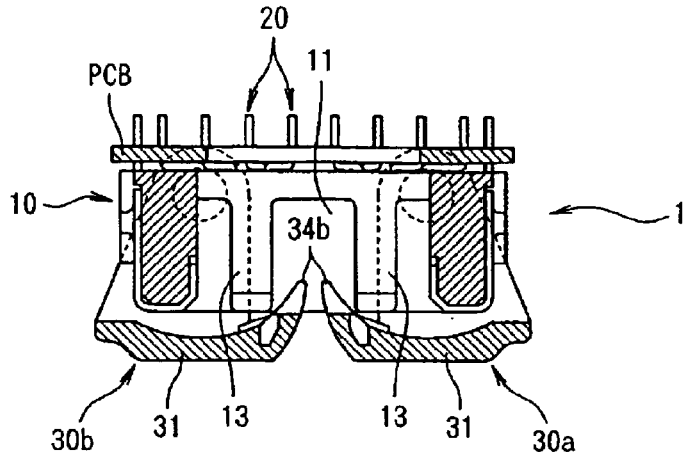
FIG. 6 is a sectional view which illustrates the mating action of the mating connector with the anti-dust shutters and connector (this figure shows sectional portions other than the contact parts in the state shown in FIG. 4)

First, in a state in which no mating connector 40 is mated with the connector 1 (as shown in FIG. 5), the flat-plate parts 31, 31 of the anti-dust shutters 30*a* and 30*b* are closed, so that the second mating recesses 12 is closed. In this state, as is shown in FIG. 6, the first mating recess 11 is also closed. Accordingly, the entry of foreign matter into the interiors of the first mating recess 11 and second mating recesses 12 is prevented by the anti-dust shutters 30*a* and 30*b*.

Figure 7:
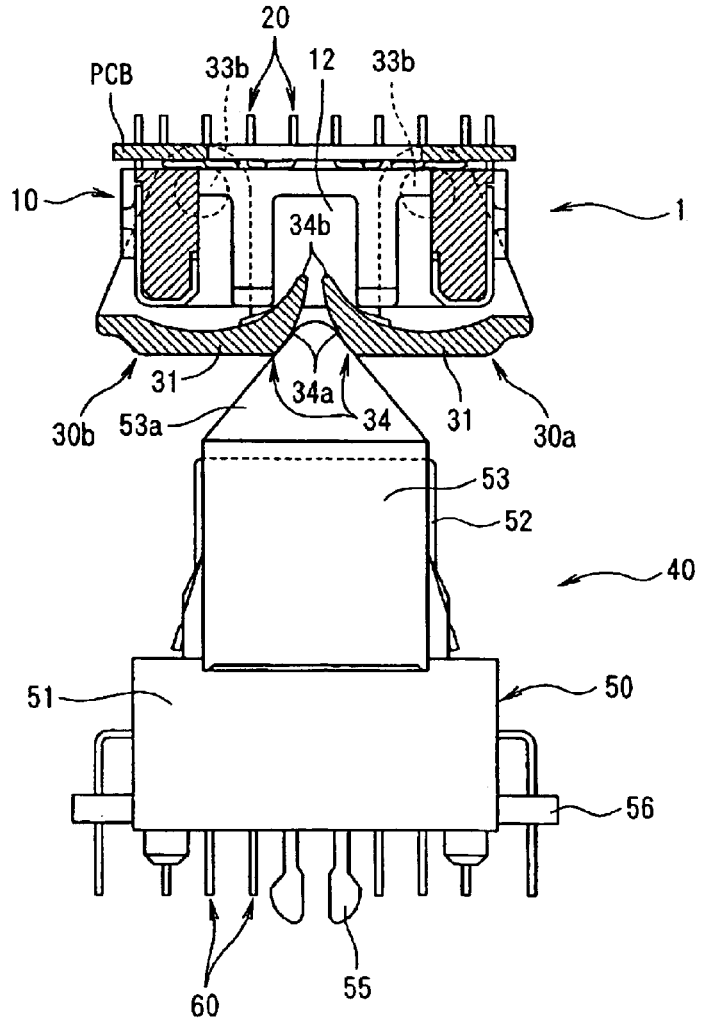
FIG. 7 is a sectional view which illustrates the mating action of the mating connector with the anti-dust shutters and connector (this figure shows a state in which the protruding portion of the guide post of the mating connector contacts the cam parts of the contact parts of the anti-dust shutters)

Next, when the mating connector 40 is caused to advance in relative terms in the direction indicated by the arrow in FIG. 5, the protruding parts 53*a* of the guide posts 53 of the mating connector 40 contact the cam parts 34*a* of the contact parts 34 of the anti-dust shutters 30*a* and 30*b* as shown in FIG. 7.

Figure 8:
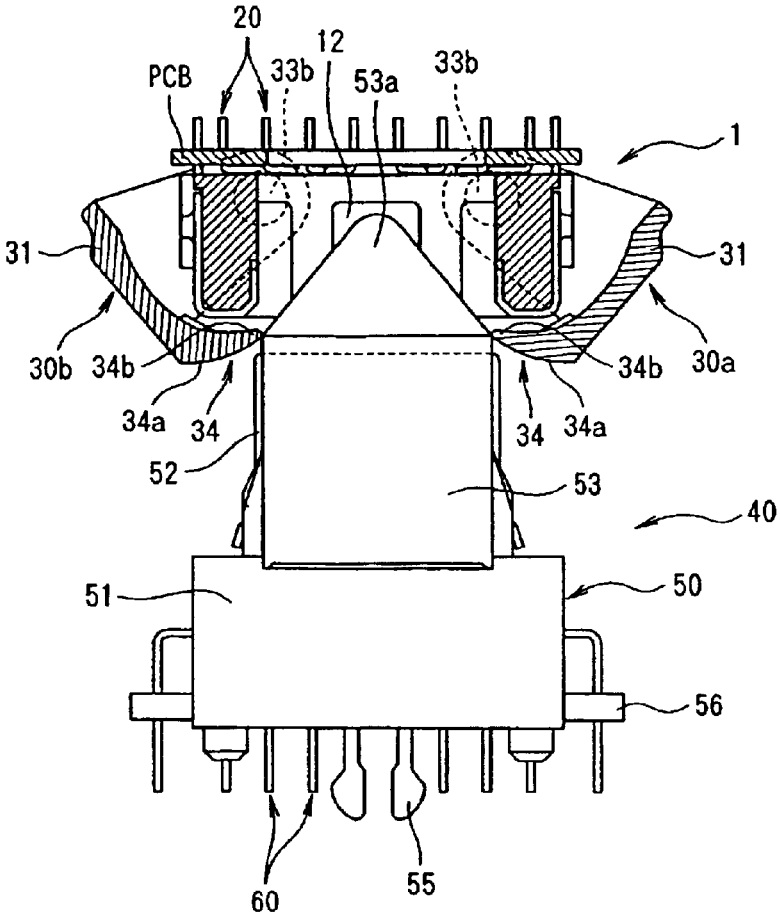
FIG. 8 is a sectional view which illustrates the mating action of the mating connector with the anti-dust shutters and connector (this figure shows a state in which the protruding portion of the guide post of the mating connector is inserted into the second mating recess)
Figure 9:
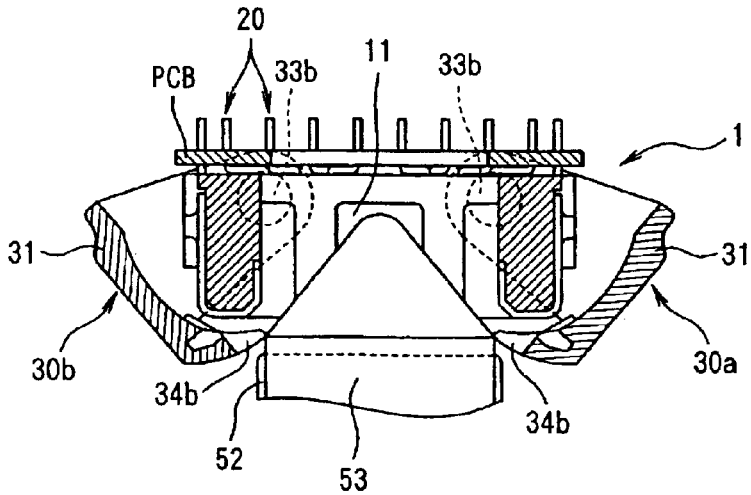
FIG. 9 is a sectional view which illustrates the mating action of the mating connector with the anti-dust shutters and connector (this figure shows sectional portions other than the contact parts in the state shown in FIG. 8)

Then, as is shown in FIG. 8, when the mating connector 40 is inserted and caused to advance even further in relative terms, the protruding part 53*a* of the guide posts 53 enters the second mating recesses 12, so that the flat-plate parts 31, 31 of the anti-dust shutters 30*a* and 30*b* pivot and open about the pivoting shafts, i.e., the shaft holes 33*a* and 33*b*, as a result of the cam action of the protruding part 53*a* and the cam parts 34*a* and protruding parts 34*b* of the contact parts 34. During the pivoting of the flat-plate parts 31, 31 of these anti-dust shutters 30*a* and 30*b*, the protruding part 53*a* of the guide posts 53 enter the second mating recesses 12 while contacting the cam surfaces of the cam parts 34*a* and cam surfaces of the protruding parts 34*b* of the contact parts 34. In the opening action of these anti-dust shutters 30*a* and 30*b*, since the protruding parts 34*b* protrude further than the other portions of the tip ends of the anti-dust shutter flat-plate parts 31, the portions of the mating connector 40 other than the guide posts 53, e.g., the mating part 52, do not contact the portions of the tip ends of the anti-dust shutter flat-plate parts 31 other than the protruding parts 34*b*, so that catching on the anti-dust shutters 30*a* and 30*b* can be prevented (as is shown in FIG. 9). Furthermore, the protruding parts 34*b* protrude into the interiors of the second mating recesses 12 when the first mating recess 11 and second mating recesses 12 are closed by the anti-dust shutters 30*a* and 30*b*. Accordingly, in the opening action of the anti-dust shutters 30*a* and 30*b*, the degree of opening of the anti-dust shutters 30*a* and 30*b* can be increased to a large degree of opening, so that catching of the mating connector 40 on the anti-dust shutters 30*a* and 30*b* can be prevented even in cases where the mating connector 40 enters while deviating with respect to the anti-dust shutters 30*a* and 30*b* and connector 1.

Figure 10:
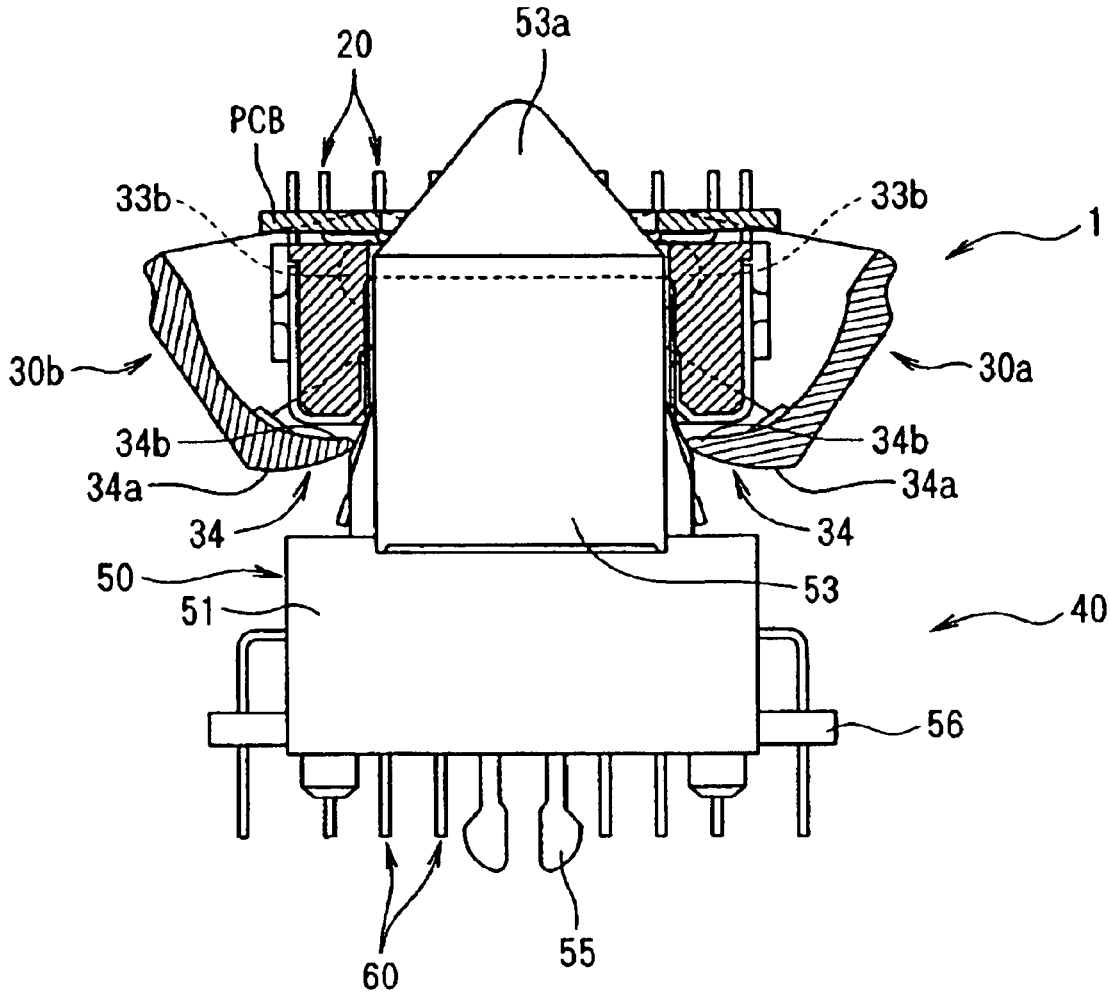
FIG. 10 is a sectional view which illustrates the mating action of the mating connector with the anti-dust shutters and connector (this figure shows a state in which the portion located further toward the root side than the protruding portion of the guide post of the mating connector is inserted into the second mating recess, so that the mating is completed)
Figure 11:
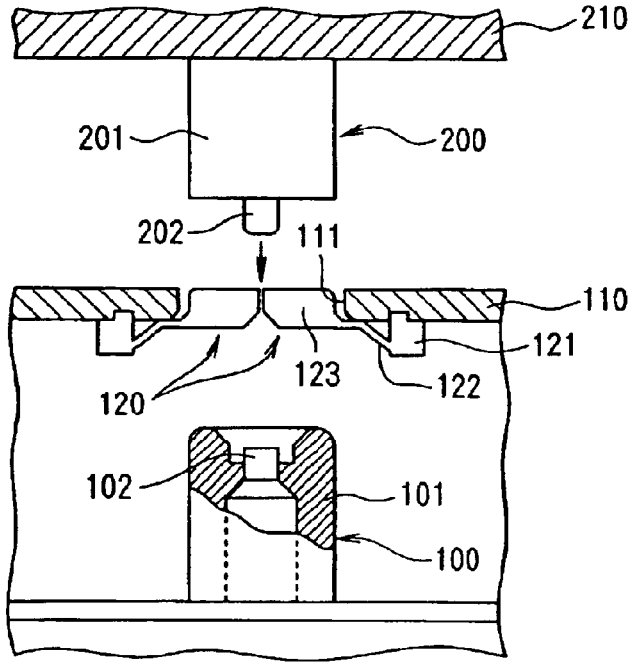
FIG. 11 is a sectional view of a conventional example, with FIG. 11(A) showing a state in which no external connector is mated with the internal connector, and FIG. 11(B) showing a state in which the mating of the external connector and internal connector has been completed.
Figure 11:
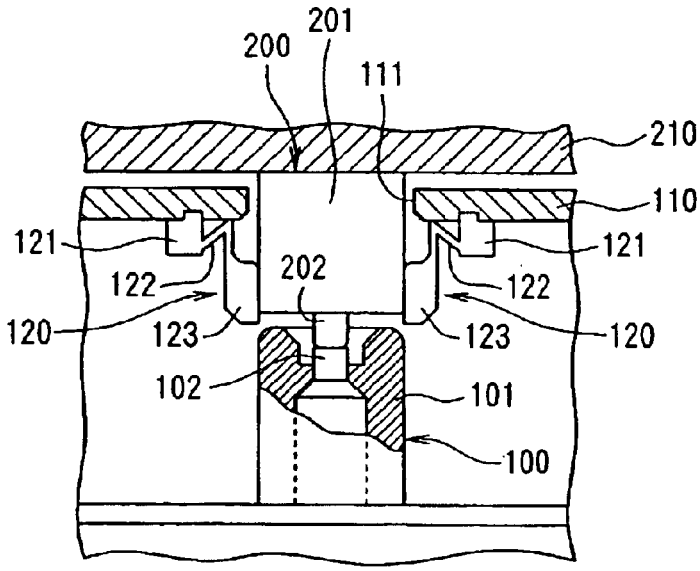

Furthermore, when the mating connector 40 is further inserted from the state shown in FIG. 8 as shown in FIG. 10, the portions of the guide posts 53 that are located further toward the root ends than the protruding parts 53*a* enter the second mating recesses 12. In this case, the flat-plate parts 31, 31 of the anti-dust shutters 30*a* and 30*b* open slightly with the tip ends of the protruding parts 34*b* in the contact parts 34 conforming to the outer circumferential surfaces of the above-mentioned root-end portions while contacting these outer circumferential surfaces. At the same time, furthermore, the mating part 52 of the mating connector 40 enters the first mating recess 11, so that the mating of the connector 1 and mating connector 40 is completed. As a result, the contacts 20 of the connector 1 and the mating contacts 60 of the mating connector 40 contact each other, and are electrically connected to each other. In this mated state as well, the portions of the mating connector 40 other than the guide posts 53 naturally do not contact the portions of the tip ends of the anti-dust shutter flat-plate parts 31 other than the protruding parts 34*b*.

Meanwhile, when the mating connector 40 is pulled out from the state of completed mating by an operation that is the reverse of the operation shown in FIGS. 5 through 10, the mated state of the connector 1 and mating connector 40 is released, and the flat-plate parts 31, 31 of the anti-dust shutters 30*a* and 30*b* close the first mating recess 11 and second mating recesses 12.

An embodiment of the present invention was described above. However, the present invention is not limited to this embodiment; various alterations are possible.

For example, a pair of anti-dust shutters 30*a* and 30*b* are installed; however, as long as the anti-dust shutters open and close the first mating recess 11 and second mating recesses 12, the present invention is not limited to such a configuration.

Furthermore, it is not absolutely necessary that the anti-dust shutters 30*a* and 30*b* be shaft-supported so that these anti-dust shutters can pivot with respect to the housing 38; it would also be possible to shaft-support the anti-dust shutters 30*a* and 30*b* on the end surfaces 16*a* and 16*b* at both ends of the housing 10 with respect to the direction of length so that the first mating recess 11 and second mating recesses 12 are opened and closed.

Furthermore, it is sufficient if the protruding parts 34*b* of the contact parts 34 protrude further than the other portions of the tip ends of the flat-plate parts 31, 31 of the anti-dust shutters 30*a* and 30*b* (other than the contact parts 34); it is not absolutely necessary that these protruding parts 34*b* protrude into the interiors of the second mating recesses 12 when the anti-dust shutters 30*a* and 30*b* close the first mating recess 11 and second mating recesses 12.

In the connector shutter in accordance with the present invention, as described above, shutter pivoting shafts are disposed facing the end surfaces of the connector at both ends of the connector with respect to the lengthwise direction, and the contact parts of the tip ends of the shutters that are contacted by the guide parts of the mating connector include protruding parts that protrude further than the other portions of the tip ends of the shutters; accordingly, no large space is required between the shutters and the connector, so that the total height of the connector and shutters can be reduced.

Furthermore, for a connector shutter in accordance with the present invention, the protruding parts protrude into the interiors of the mating recesses when the mating recesses are closed by the shutters; accordingly, in the opening action of the shutters, the degree of opening of the shutters can be set at a large degree of opening, so that catching of the mating connector on the shutters can be prevented even in cases where the mating connector advances into the connector while deviating from the center with respect to the shutters and connector.

What is claimed is:

1. A connector shutter assembly for protecting an elongated connector mounted in a device, said connector having a top and bottom orientation and a mating recess accessible from the top of said connector, said connector shutter assembly defining a closed position for covering said mating recess in an unmated state and an open position for allowing a mating connector to enter said mating recess to effect a mated state with said connector, said connector shutter assembly comprising:

a first shutter having a first elongated substantially flat portion extending along the elongated direction of the connector, a first contact portion adjacent said first elongated substantially flat portion, and first parallel side plates orthogonally disposed at each end of said first elongated substantially flat portion and pivotally mounted to said device;

a second shutter having a second elongated substantially flat portion parallel to said first elongated substantially flat portion, a second contact portion adjacent said second elongated substantially flat portion and opposed to said first contact portion when said shutter assembly is in the closed position, and second parallel side plates orthogonally disposed at each end of said second elongated substantially flat portion and pivotally mounted to said device;

at least one resilient member connected to said first and second shutters to urge said first and second elongated substantially flat portions together to said closed position to cover said mating recess of said connector;

wherein, said first and second contact portions each have a cam surface such that, during mating, when a protruding portion of a mating connector is urged against said first and second contact portions, the force of said mating connector against the cam surfaces forces said first and second shutters to pivot independently and away from said connector to open said shutter assembly to provide access to said mating recess during mating.

2. The connector shutter assembly of claim 1, wherein said first and second parallel side plates are pivotally mounted to said device at a point below the top of said connector.

3. The connector shutter assembly of claim 2, wherein said first and second parallel side plates are pivotally mounted to said device at a point toward the bottom of said connector.

4. The connector shutter assembly of claim 1, wherein said first and second contact portions are the only portion of the first and second shutters which contact the mating connector.

5. The connector shutter assembly of claim 1, wherein said first and second contact portions comprise first and second protruding portions, respectively, which extend into said mating recess when said shutter assembly is in a closed position.

6. The connector shutter assembly of claim 5, wherein said cam surfaces are at least partially on said first and second protruding portions.

7. The connector shutter assembly of claim 1, further comprising said connector.

8. The connector shutter assembly of claim 7, further comprising said device.

9. The connector shutter assembly of claim 1, wherein said connector is an electrical connector.

10. A device comprising:

a housing;

an elongated connector, said connector having a top and bottom orientation and a mating recess accessible from the top of said connector, a connector shutter assembly defining a closed position for covering said mating recess in an unmated state and an open position for allowing a mating connector to enter said mating recess to effect a mated state with said connector, said connector shutter assembly comprising at least:

a first shutter having a first elongated substantially flat portion oriented alone the direction of elongation of said connector, a first contact portion adjacent said first elongated substantially flat portion, and first parallel side plates orthogonally disposed at each end of said first elongated substantially flat portion and pivotally mounted to said device;

a second shutter having a second elongated substantially flat portion parallel to said first elongated substantially flat portion, a second contact portion adjacent said second elongated substantially flat portion and opposed to said first contact portion when said shutter assembly is in the closed position, and second parallel side plates orthogonally disposed at each end of said second elongated substantially flat portion and pivotally mounted to said device;

at least one resilient member connected to said first and second shutters to urge said first and second elongated substantially flat portions together to said closed position to cover said mating recess of said connector;

wherein, said first and second contact portions have a cam surface such that, during mating, when a protruding portion of a mating connector is urged against said first and second contact portions, the force of said mating connector moving along the cam surfaces forces said first and second shutters to pivot independently and away from said connector to open said shutter assembly and provide access to said mating recess during mating.

11. The device of claim 10, wherein said first and second parallel side plates are pivotally mounted to said device at a point below the top of said connector.

12. The device of claim 11, wherein said first and second parallel side plates are pivotally mounted to said device at a point toward the bottom of said connector.

13. The device of claim 10, wherein said first and second contact portions are the only portion of the first and second shutters which contact the mating connector.

14. The device of claim 13, wherein said first and second contact portions comprise first and second protruding portions, respectively, which extend into said mating recess when said shutter assembly is in a closed position.

15. The device of claim 14, wherein said cam surfaces are at least partially on said first and second protruding portions.

* * * * *